US005810318A

United States Patent [19]

Federico

[11] Patent Number: 5,810,318

[45] Date of Patent: Sep. 22, 1998

[54] FLAG ORNAMENT

[76] Inventor: Vincent Federico, 5 Elm Ct., Howell, N.J. 07731

[21] Appl. No.: 650,374

[22] Filed: May 20, 1996

[51] Int. Cl.[6] ..... A47G 25/12

[52] U.S. Cl. ..... 248/539; D11/166; D11/182; 248/915

[58] Field of Search ..... 248/534, 535, 248/538, 539, 541, 511, 915; 473/116; 52/40; 116/173; D11/182, 166

[56] References Cited

U.S. PATENT DOCUMENTS

| | | | |
|---|---|---|---|
| D. 340,676 | 10/1993 | Gallagher | D11/182 |
| D. 365,308 | 12/1995 | White | D11/182 |
| 593,601 | 11/1897 | Neely | 248/534 |
| 1,273,098 | 7/1918 | Schumann | 248/538 X |
| 1,286,541 | 12/1918 | Cook | 248/534 X |
| 1,597,266 | 8/1926 | Dearman | D11/182 X |
| 2,298,744 | 10/1942 | Liermann | 248/534 X |
| 5,396,915 | 3/1995 | Bomar | 248/534 X |
| 5,478,041 | 12/1995 | Mayne | 248/534 X |

*Primary Examiner*—Ramon O. Ramirez

[57] ABSTRACT

An ornament for a flag includes a three-dimensional object symbolic of a person, place, thing or event and can be attached to a flag pole The ornament can be mounted on a selected position of the pole to adorn the flag and enhance its symbolism, and can be used to mount or support the flag on a wall or surface The ornament can take many forms and can be, for example, represent the Statue of Liberty, historical events, specific individuals, special holidays, etc.

3 Claims, 1 Drawing Sheet

FLAG ORNAMENT

BACKGROUND OF THE INVENTION

Displaying a flag is a traditional way in which one displays patriotism to country or to a group, cause or organization symbolized by the flag. While the fabric banner attached to the flag pole or post bears the appropriate indicia, efforts have been made to adorn a flag and enhance or further glorify the significance of the flag. One example is the use of highly polished balls or spheres at the upper end of the pole, typically of gold, silver or brass finish. Other objects have been mounted at the tops of flagpoles to supplement or compliment the symbolism represented by the flag itself. Thus, three dimensional models of the American eagle, typically with wings spread, are frequently mounted at the tops of poles of American flags. However, aside from the foregoing placements of objects at the tops of flag poles flags have not been adorned with three-dimensional objects which have special meaning to the user of the flag whether that special meaning relates to a special event, group or country. This is notwithstanding the fact that patriotic or nationalistic three dimensional objects are quite common, such as the statue or sculpure illustrated in U.S. Pat. No. 1,257,865. Also, while brackets for mounting an object on a structure are known, such as the funeral marker for automobiles disclosed in U.S. Pat. No. 1,861,366, such brackets or other mounting members have not been used to mount symbolic national sculptures or statues on flag poles to enhance the flag during special holidays or functions.

SUMMARY OF THE INVENTION

It is a primary object of the present invention to provide an ornament for adorning a flag on the lower part of the flagpole below the fabric portion of the flag.

It is another object to provide a flag ornament of the type mentioned in the last object which also serves as a support for supporting the flag on a wall or other surface.

It is still another object to provide a flag ornament of the type aforementioned which can be Customized to provide any desired symbolism.

It is yet another object of the invention to provide a flag ornament which can be easily and conveniently placed on, removed or replaced on a flag pole.

In order to achieve the above objects as well as others which will become evident to those skilled In the art, an ornament for decorating the pole of a flag, in accordance with the present invention, comprises a first portion defining a three dimensional sculpture. The three dimensional first portion is connected to a second portion which has a generally cylindrical opening dimensioned for receiving at least a portion of the pole of a flag. Means is provided for maintaining the ornament on a selected portion of the flag pole. Said first and second portions can be mated with the flag pole and the ornament can be contemporaneously displayed in association with the flag. The second portion can either be configured to position the ornament at any selected position on the pole or only receive the lower end of the flag pole in which case the device can also be used to support the flag on a wall or other surface.

BRIEF DESCRIPTION OF THE DRAWINGS

For a fuller understanding of the nature and objects of the invention, reference will be made to the following detailed description taken in connection with the accompanying drawings, in which.

DESCRIPTION OF THE PREFERRED EMBODIMENTS

Figure 1:
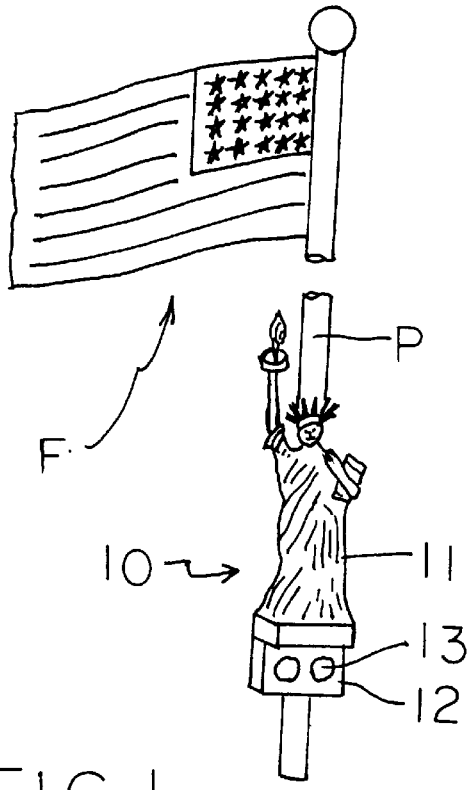
FIG. 1 is front elevational view, partially fragmented, of a flag ornament in accordance with the invention shown mounted on an intermediate part of the pole below the flag.

Referring now more specifically to the drawings, in which identical or similar parts are designated by the same reference numerals throughout, and first referring to FIG. 1, a flag ornament in accordance with one embodiment of the invention is generally designated by the reference numeral 10.

The flag ornament or device 10 is intended to be used with a flag of conventional design which includes a pole or post P on which there is mounted the fabric flag F. The specific materials from which the flag is made is not important for the purposes of the present invention.

The device 10, in FIG. 1, includes a first portion 11 which is in the nature of a three-dimensional sculpture or ornament shown, by way of example only, to be in the likeness of the Statue of Liberty. The ornament 11 is mounted on a base or pedestal 12 shown in the form of a right angle bracket having holes 13 which can be used to mount the bracket on a wall or other surface.

Figure 2:
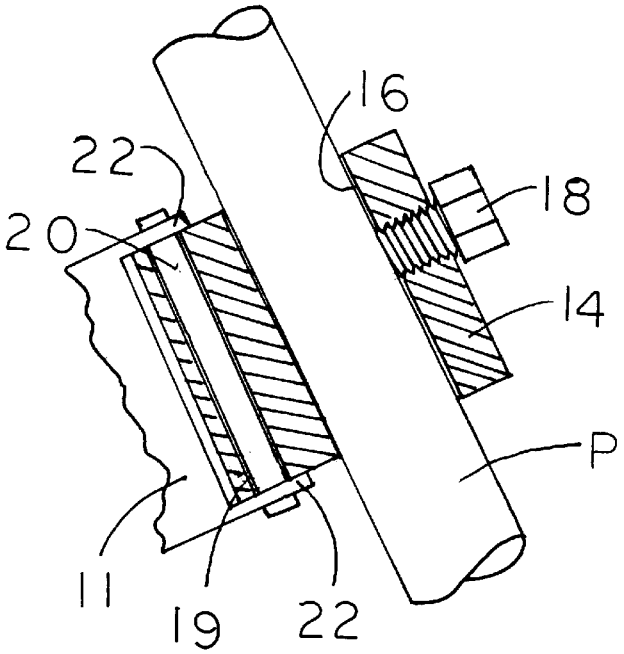
FIG. 2 is a side elevational view, partially fragmented and in cross-section, of the ornament shown in FIG. 1.

Referring to FIG. 2, the rear portion of the sculpture or ornament 11 is shown to be pivotably connected to a cylindrical ring or sleeve 14 which has a hole or opening 16 dimensioned to receive the flag pole or post P with some clearance to allow easy insertion and removal of the pole. A set screw 18 or other suitable means is used to fix the position of the ring or sleeve and, therefore, the ornament 11 on a selected portion of the pole P. Normally the ornament 11 should be placed on the pole P just below the flag F, when the flag is being carried or when the flag is supported on a wall or other surface by any conventional means. When the device 10 is also used as a mounting device the ornament is normally positioned at the bottom free end of the pole P, as will be more fully described in FIG. 3. However, as suggested in FIG. 1, the base or pedestal 12 may be dimensioned or configured to permit attachment of the ornament when it is positioned in an intermediate position on the pole or post P.

The ring or sleeve 14 is provided, on the side of the ornament 11 with a hole or bore 19 dimensioned to receive a pin 20 which is dimensioned to extend through flanges or lugs 22 extending rearwardly of the ornament. Sufficient clearances are provided between the ornament and the ring or sleeve to permit pivoting or rotation of the ornament 11 about the pin 20 relative to the ring or sleeve 14. Preferably, friction or braking means is provided, such as pressure fit, to prevent free or uncontrolled pivoting or rotation, so that the ornament 11 can be rotated to a desired position and remain in that position. Therefore, the ornament 11 can be shifted to any position both by rotating the sleeve or ring 14 and pivoting or rotation of the ornament 11 about the pin 20.

Figure 3:
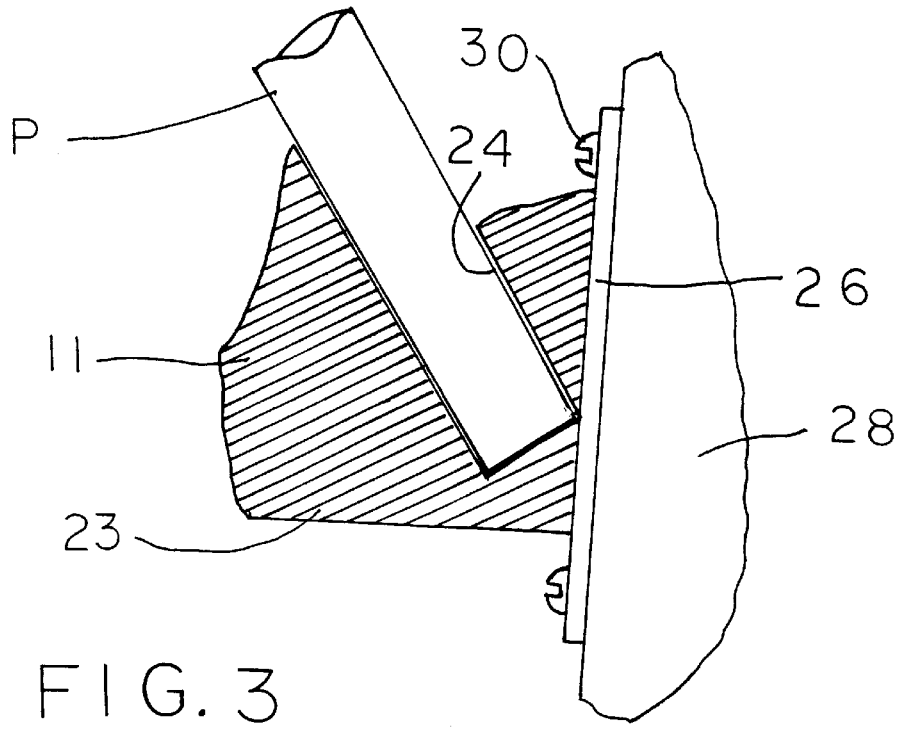
FIG. 3 is similar to FIG. 2 but showing a further embodiment of the flag ornament supporting the flag on a surface.

Referring to FIG. 3, an alternate embodiment is shown which is only intended to mount or support the pole or post P on a wall or other surface. Here, the ornament 11 may be fixed to or integrally formed with the base or second portion 23. The base or portion 23 is provided with a hole or bore 24 which is closed at the lower end thereof so that the pole or post P can be received and supported as shown. Here, the base 23 is shown fixed to a support plate 26 which can be attached to a wall or other surface 28 by means of screws 30 or the like.

As will be evident, the ornament can be in the form of a solid three dimensional object, such as a model of the Statue of Liberty, or can be any other ornament, such as a yellow ribbon. Any ornament can be used and attached, in any known or conventional way, to either the ring or the sleeve 14 or to the base 23.

The flag ornament 10 can, as suggested, be used to adorn a flag for any occasion. While common patriotic symbols, such as an American eagle or Statue of Liberty, can be used at all times, the ornament can also be effectively used for special events which occur only once or infrequently.

The size of the ornament 11 relative to the size of the pole or post P is not critical and is a matter of design choice.

It will thus be seen that various changes may be made in the above constructions without departing from the spirit and scope of the invention, and it is intended that the above description shall be interpreted as illustrative and not in a limiting sense, and the invention is not intended to be limited except as shall appear from the spirit and scope of the appended claims.

I claim:

1. An ornament for decorating a flag mounted at one end of a flag pole, comprising a three-dimensional sculpture having a through hole or opening dimensioned to receive any portion of the flag pole therethrough; and securing means for maintaining the ornament on any selected portion of the flag pole below the flag, whereby said sculpture can be mounted on the flag pole and the ornament can be moved to any portion of the flag pole and fixedly secured thereto to be contemporaneously displayed in association with the flag.

2. An ornament as defined in claim 1, wherein said securing means comprises a set screw.

3. An ornament as defined in claim 1, wherein said sculpture comprises a three-dimensional likeness of the Statue of Liberty.

* * * * *